166-66 SR

6/3/86 OR 4,592,421

United States Patent [19]

Hoffmann et al.

[11] Patent Number: 4,592,421

[45] Date of Patent: Jun. 3, 1986

[54] SUCKER RODS

[75] Inventors: Jürgen Hoffmann, Cologne; Lothar Preis, Bergisch-Gladbach, both of Fed. Rep. of Germany

[73] Assignee: Bayer Aktiengesellschaft, Leverkusen, Fed. Rep. of Germany

[21] Appl. No.: 649,017

[22] Filed: Sep. 10, 1984

[30] Foreign Application Priority Data

Sep. 30, 1983 [DE] Fed. Rep. of Germany ..... 3335607

[51] Int. Cl.[4] ..... E21B 17/00

[52] U.S. Cl. ..... 166/66; 166/68; 166/72; 166/105; 350/96.29; 403/312; 417/545

[58] Field of Search ..... 166/68, 242, 65 R, 72, 166/176, 105, 108, 105.2, 66; 403/302, 312, 373; 428/364; 417/545; 350/96.29, 96.23

[56] References Cited

U.S. PATENT DOCUMENTS

| | | | |
|---|---|---|---|
| 1,801,235 | 4/1931 | Hill | 403/312 |
| 2,728,396 | 12/1955 | Carpenter | 166/60 |
| 3,329,212 | 7/1967 | Pourchot | 166/176 |
| 3,486,557 | 12/1969 | Harrison | 166/68 |
| 3,859,503 | 1/1975 | Palone | 166/60 |
| 3,889,579 | 6/1975 | Wiechowski et al. | 417/545 |
| 4,024,913 | 5/1977 | Grable | 166/72 |
| 4,139,334 | 2/1979 | Payne et al. | 417/545 |
| 4,214,693 | 7/1980 | Smith | 350/96.29 |

FOREIGN PATENT DOCUMENTS

| | | | |
|---|---|---|---|
| 1087521 | 10/1980 | Canada | 166/72 |
| 197808 | 8/1978 | France | 403/312 |

*Primary Examiner*—James A. Leppink
*Assistant Examiner*—Hoang C. Dang
*Attorney, Agent, or Firm*—Sprung Horn Kramer & Woods

[57] ABSTRACT

The sucker rod system in a deep well sucker rod pump consists of a plurality of unidirectionally reinforced composite fiber rods extending substantially parallel but not in contact with each other, the cross-sectional area of which rods is less than 1 cm$^2$. This enables the advantageous material properties to be utilized to a high degree. The sucker rod system can be assembled on site. The individual composite fiber rods can be monitored when they are in the working position.

9 Claims, 5 Drawing Figures

SUCKER RODS

BACKGROUND OF THE INVENTION

This invention relates to a deep well pump with sucker rods, in which a piston suspended from a system of sucker rods in a rising pipe is moved up and down in a pump casing at the bottom of the rising pipe by an above-ground pump drive.

In pumps of this kind, the pump itself in the ground may be separated from the drive by several thousand meters. The transmission of force through sucker rods is of great importance. The sucker rods conventionally consist of rods of standard structural steel of about 7.5 m in length screwed together. This system of sucker rods is very heavy.

Since the material delivered by the pump may contain corrosive constituents, it is proposed in Canadian Patent Specification 1 087,521 to replace the steel rods by rods made of composite fiber material. To enable the rods to be joined together, steel sleeves are glued to the ends of the rods. Apart from the considerable cost of manufacture and the additional weight due to the sleeves, the connections constitute weak points which are still liable to be corroded and only enable the mechanical strength of the fiber reinforced rods to be utilized to a very limited extent.

SUMMARY OF THE INVENTION

It is an object of the present invention to provide a system of sucker rods for deep well pumps in which the problems occurring in known sucker rods are eliminated or at least reduced. This object is achieved in accordance with the invention wherein the system of sucker rods consists of a plurality of unidirectionally reinforced composite fiber rods with a constant cross-section over the whole length less than 1 $cm^2$ which extend substantially parallel to each other but are not in contact with each other. Further developments of the invention are described hereinafter.

The advantages achieved with the invention are in particular that owing to the material used, no problems of corrosion occur; that a considerable saving in weight is obtained due to the elimination of connecting sleeves so that the driving power and stability of the force transmission apparatus need not be so high; and that further economic advantage can be obtained by the simplified assembly. Failure of one composite fiber rod does not cause immediate failure or destruction of the whole system of rods.

This system of force transmission requires only two connecting elements, one at the top and one at the bottom, advantageously in the form of anchoring clamping plates.

Even if these connecting elements must be manufactured from expensive steel owing to the corrosive surroundings, a very considerable reduction in cost and weight is still achieved. This system of sucker rods enables much greater use to be made of the excellent mechanical strength properties of the unidirectionally reinforced composite fiber material.

Since a system of rods is built up of several composite fiber rods, it can easily be adapted to individual requirements by varying the number of rods. A rolled up endless strand of composite fiber rods having a cross-section, for example, of 0.75 $cm^2$ is in principle sufficient to cover all the requirements occurring in practice. The rods of composite fiber material in all cases extend continuously from the lower anchoring clamping plate to the upper end since adaptation of the cross-section, such as is occasionally carried out when steel rods are used, is now not necessary and affords no advantages in cost.

The composite fiber rods consist of unidirectionally reinforced material, such as that described, for example, in EP-PS 0,000,734 and that available commercially, for example under the trade name Polystal®. Thus, all composite fiber rods containing 70 to 85% by weight of (endless) filaments composed of glass fibers, carbon fibers or ceramicle fibers are suitable. Epoxy, polyester, polyurethane or phenol resins can be used as the reaction resins. The gross density is between 1.4 and 2.2 $kg/dm^2$. Suitable cross-sectional areas are those between 20 $mm^2$ and 100 $mm^2$, especially those between 40 $mm^2$ and 80 $mm^2$. The tensile strength is between 1,000 $N/mm^2$ and 2,000 $N/mm^2$. The bending modulus—relative to the whole cross-section—is between 40,000 $N/mm^2$ and 200,000 $N/mm^2$. The composite fiber rods of the stated dimensions can be wound on to drums. The transportation and the handling by introduction into the rising pipe is thereby substantially simplified.

Some boreholes do not extend completely vertically or may be set back in places or curved. The sucker rods according to this invention are eminently suitable for compensating for such irregularities. For this purpose, it may be indicated to provide guide or support elements in the form of spacers on the rods at several levels along the rising pipe. These spacers are preferably manufactured from thermoplastic polymers which may be attached to the sucker rods, e.g. by clamping. Moreover, the pulsations of the sucker rods can be influenced by the number and arrangement of the spacers.

An equally simple arrangement may also be used to seal the sucker rods in the upper region of the rising pipe. In conventional deep well pumps with sucker rods, the so-called "master rod" is required for this purpose.

The system of sucker rods is not subject to corrosion.

According to a further feature of the invention, each individual rod of conventional fiber material can be tested for its fitness for use even when installed in the well. Damage to individual composite fiber elements is sometimes unavoidable under the circumstances, even when very high quality material is used. In the sucker rods previously used this had catastrophic consequences since recovery of a pump with a broken sucker rod system may take several days in some cases. In the case of the sucker rods according to the invention, it is easy to ascertain on each individual composte fiber rod at least whether it is broken or not, simply by embedding an indicator in the composite fiber material in the course of the continuous manufacturing process of the endless strand. The indicators used are preferably metallic conductors or photoconductors. The electric resistance is particularly easily measured. When photoconductors are used, the distance of a technical fault can be assessed approximately from the attenuation in light. The severity of damage can be assessed on the basis of such measurements and if, for example, only one fiber rod is destroyed in a system of 12 rods, it may be perfectly safe to continue operation if the 12 rods constitute spare capacity, whereas without such separate control it might be necessary to dismantle the whole system.

The sucker rod system according to this invention may also be composed of a combination of differing composite fiber rods, in particular rods differing in their fiber content or in the types of fiber reinforcement used. Such variation may be used to influence the pulsation characteristics of a sucker rods.

The individual composite fiber rods may be encased in a thermoplastic, for example as additional protection against corrosion and mechanical damage.

The invention is illustrated in the drawings and described in more detail below by way of example. In the drawings:

DETAILED DESCRIPTION OF THE INVENTION

Figure 1:
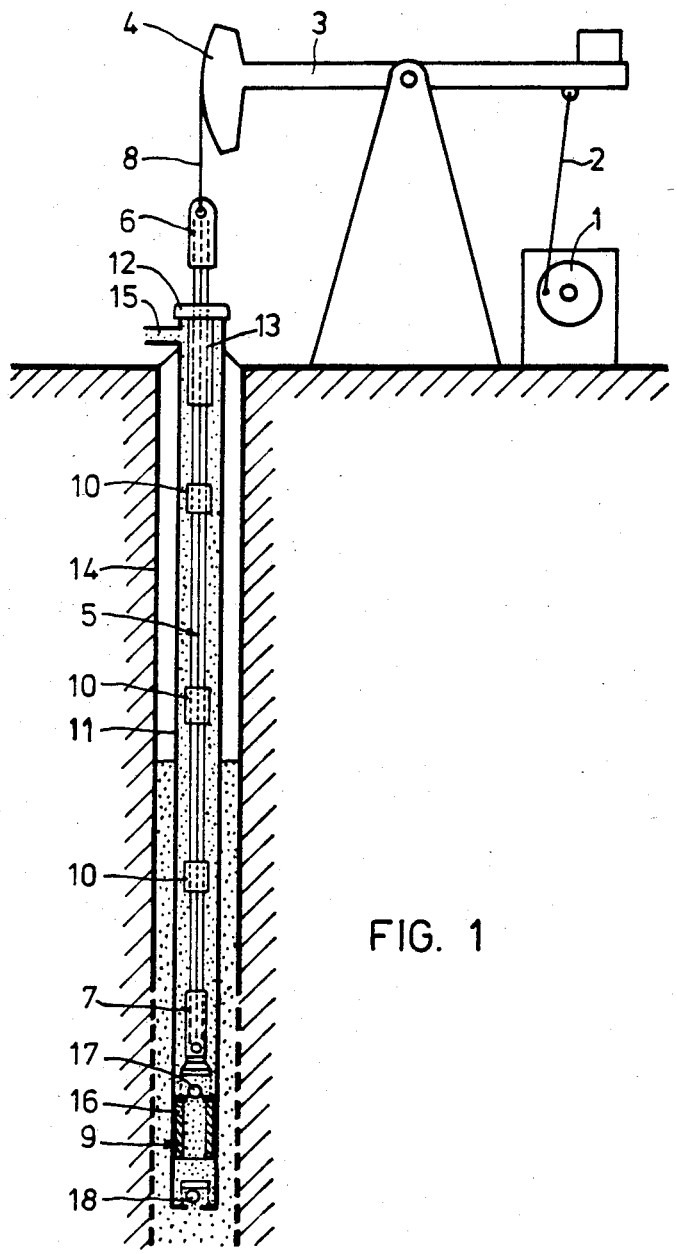
FIG. 1 is a schematic representation of a deep well sucker rod pump.

Referring now to FIG. 1, the pump handle 3 with its so-called "horsehead" 4 at the end is moved by the above ground drive 1 by way of the connecting rod 2. The system of sucker rods 5 is continuous without any intermediate connections and consists of a plurality of unidirectionally reinforced composite fiber elements. These rods are held at their beginning and end by the upper and lower anchoring clamping plate 6 and 7, respectively, which establish the connection to the head 4 by way of the cable 8 and to the pump 9. Spacers 10 are provided to guide the sucker rods 5. In the deep well sucker rod pumps hitherto known, the upper region of the rising pipe 11 is sealed off by a packing gland 12 through which the master rod extends.

In the pump according to the invention, a plastic cylinder 13 of suitable length is provided in this region to serve as a "spacer" and take over the sealing function. The rising pipe 11 is surrounded by a lining pipe 14 which is perforated in the lower region. The liquid is removed at the head 15 of the rising pipe 11. The piston 16, piston valve 17 and foot valve 18 are indicated on the pump 9.

Figure 2:
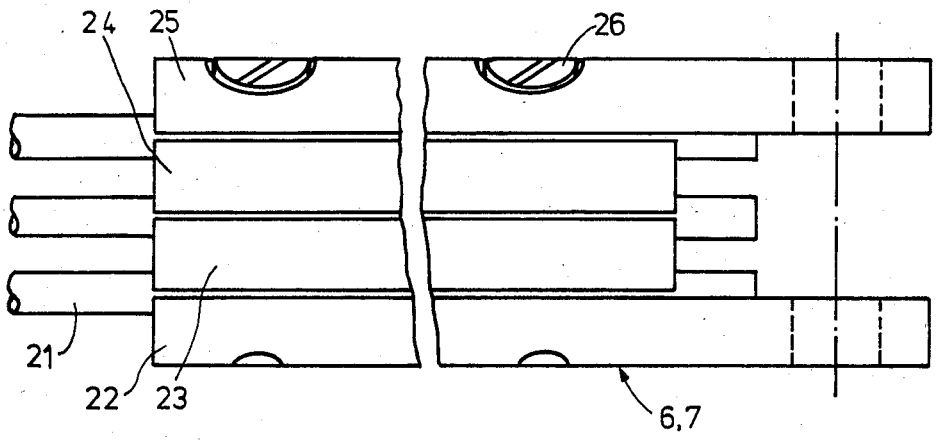
FIG. 2 shows the anchoring clamping plate of a system of six sucker rods of composite fiber material.
Figure 3:
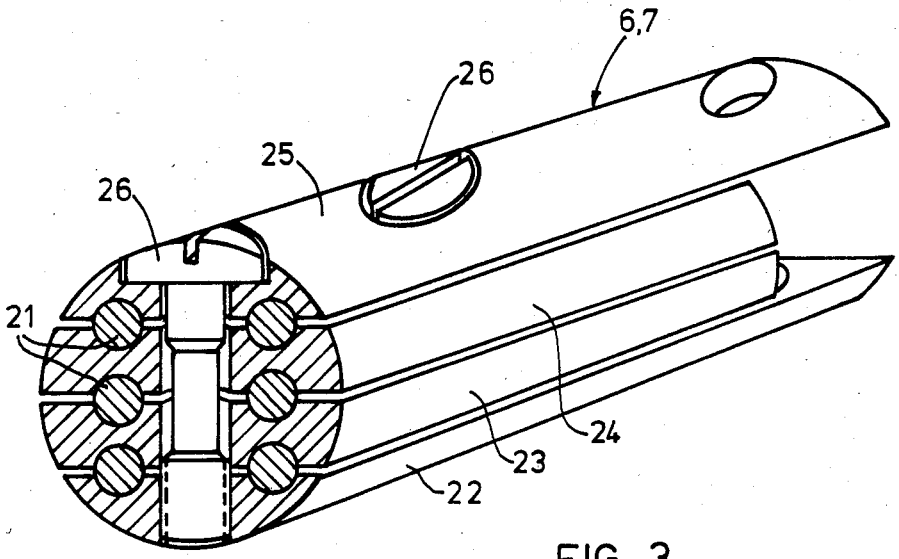
FIG. 3 is a perspective view of a section through FIG. 2.

Owing to the high strength of the unidirectionally reinforced composite fiber material, it is very important to provide a suitable anchoring clamping plate for introducing the force. Such an element for six circular composite fiber rods 21 is shown in FIGS. 2 and 3. The diameter of each composite fiber rod 21 is in this case 7.5 mm. The anchorage consists of several clamping plates 22, 23, 24, 25 arranged above one another, in which the composite fiber rods 21 are embedded in form locking engagement, so that a very satisfactory volumetric compression pressure is possible. The clamping plates 22, 23, 24, 25 are braced together by necked down screws 26. These screws 26 also serve to prevent the clamping plates 22, 23, 24, 25 from sliding over each other. The maximum load bearing capacity of a rod 21 of composite fiber material is about 60 kN, the modulus of elasticity about 50,000 N/mm$^2$. In a borehole 2000 m deep, this amounts to a weight of unidirectionally reinforced composite fiber rods of about 1200 kg, while clamping plates, master rod and spaces amount approximately to a further 200 kg. No suction rods approaching such capacity have hitherto been known.

Figure 4:
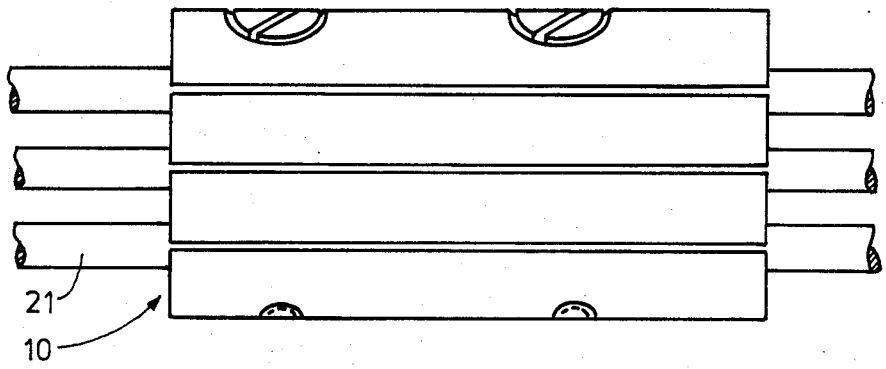
FIG. 4 shows a spacer.

FIG. 4 shows a spacer 10 constructed in substantially the same manner as an anchoring clamping plate, but its external diameter is adjusted to the internal diameter of the rising pipe 11 and it is normally made of a plastic material instead of steel. It prevents friction of the sucker rods against the wall of the pipe in the event of damage or if the boreholes are crooked, and it improves the support and guidance of the rods. The master rod is similarly manufactured from a plastic material but is longer than a spacer 10.

Figure 5:
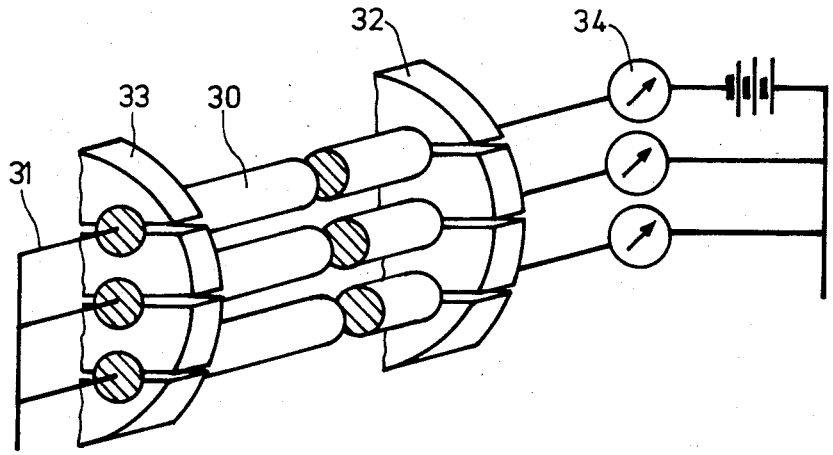
FIG. 5 illustrates the monitoring of the individual rods of composite fiber by a conductive wire inserted in them.

Monitoring of the individual composite fiber rods is illustrated schematically in FIG. 5. Conductor 31, which may be either an electrical conductor or a photoconductive cable, is inserted in each composite fiber rod 30 at the stage of manufacture of the rod. For the sake of simplicity, only three such composite fiber rods and the upper and lower anchoring clamping plates 32 and 33 have been illustrated schematically. Each conductor 31 extends out of the end of its composite fiber tube 30. The conductors 31 are all joined together in the region of the lower anchoring clamping plate 33. The conductors 31 extending from the upper clamping plate 32 are connected to measuring instruments 34, such as conductivity instruments, ultrasound measurers or instruments for measuring the attenuation of light.

The sucker rods may be assembled on site. The "endless composite fiber rods" wound on drums are carried to the borehole. At the borehole, the ends of the composite fiber rods and the electric control device are first fitted to the clamping plate near the pump and connected to the pump. The pump is then lowered into the borehole. The speed at which it is lowered is regulated by a brake device on the winding drums. If required, spacers are screwed into position at certain intervals. When the pump has reached its position, the anchoring clamping plate near the drive is assembled and connected to the cable mounting head of the "horse" head of the pump. Shortly before the pump reaches its end position, the guide element serving as master rod is fitted to the rods of composite fiber material.

EXAMPLE

For the exploration of oil a pump was lowered into a bore hole by six round sucker rods with a total cross-section of 265 mm$^2$, consisting of 80% by weight of E-glass fiber and 20% by weight of polyester resin. The material is characterized by Tensile strength: 1,400 to 1,500 N/mm$^2$
Elongation at break (DIN 53,455): 3%
Modulus of elasticity: 45,000 to 51,000 N/mm$^2$
Specific weight: 2 g/cm$^3$
Coefficient of expansion: $7\times10^{-6}$/°C.

The fiber rods are joined together by clamping plates in several points. By a safety factor of 6 times the six sucker rods can carry a weight of 60 kN. The weight of the rods amounts to 1,200 kg by a bore hole depth of 2,000 m. Therefore, a working-load of nearly 59 kN can be used.

What is claimed is:

1. In a deep well sucker rod pump wherein a piston suspended from a system of sucker rods in a rising pipe is moved up and down in a pump casing at the bottom of the rising pipe by an above ground pump drive, the improvement wherein the sucker rod system comprises a plurality of unidirectionally reinforced composite fiber rods each having a cross-sectional area of from 20 to 100 $mm^2$ and spacer means connected to the rods to maintain the rods substantially parallel to each other and not in contact with each other.

2. The system according to claim 1, further comprising an upper and lower anchoring clamping plate connecting the sucker rods with the piston and its drive.

3. The system according to claim 2, further comprising an electric conductor in each composite fiber rod, means joining the conductors together in the region of the lower anchoring clamping plate and a conductivity measuring instrument connected to the conductors.

4. The system according to claim 2, wherein each composite fiber rod contains a metallic conductor and the conductors extend sufficiently far out in the region of the upper anchoring clamping plate and connectable to an instrument for measuring ultrasound.

5. The system according to claim 2, wherein each composite fiber rod contains a photoconductive cable and the photoconductive cables extend sufficiently far out in the region of the upper clamping plate to be connectable to an instrument for measuring the attenuation of light.

6. The system according to claim 1, wherein the spacing means comprise spacers of plastic material clamped to the composite fiber rods and configured to guide the sucker rod system in the rising pipe.

7. The system according to claim 1, further comprising a plastic cylinder clamped to the composite fiber rods to seal off the sucker rod system at the upper end of the rising pipe.

8. The system according to claim 1, wherein the sucker rod system consists of differing composite fiber rods, including those with differing fibers or proportions of fibers.

9. The system according to claim 1, wherein the composite fiber rods are sheathed in thermoplastic polymers.

* * * * *